US008261964B2

(12) United States Patent
Raupach et al.

(10) Patent No.: US 8,261,964 B2
(45) Date of Patent: Sep. 11, 2012

(54) CARTON PACKAGING WITH FILM INTERNAL CONTAINER, PREFABRICATED CARTON UNIT FOR THE PRODUCTION THEREOF, AND PROCESS FOR THE PRODUCTION OF CARTON PACKAGING OF THIS TYPE

(75) Inventors: Roland Raupach, Reinheim (DE); Bettina Straub-Jubb, Weiterstadt (DE); Thomas Ritz, Lauterbach (DE)

(73) Assignees: Merck Patent GmbH, Darmstadt (DE); STI Gustav Stabernack GmbH, Lauterbach (DE)

( * ) Notice: Subject to any disclaimer, the term of this patent is extended or adjusted under 35 U.S.C. 154(b) by 166 days.

(21) Appl. No.: 12/668,874

(22) PCT Filed: Jun. 17, 2008

(86) PCT No.: PCT/EP2008/004877

§ 371 (c)(1),
(2), (4) Date: Jan. 12, 2010

(87) PCT Pub. No.: WO2009/010143

PCT Pub. Date: Jan. 22, 2009

(65) Prior Publication Data

US 2010/0187294 A1 Jul. 29, 2010

(30) Foreign Application Priority Data

Jul. 13, 2007 (DE) ..... 10 2007 033 141

(51) Int. Cl.
*B65D 5/42* (2006.01)

(52) U.S. Cl. ..... 229/117.3; 229/120.01; 229/117.35; 221/302; 222/105

(58) Field of Classification Search ..... 229/120.01, 229/117.3, 122.24, 920, 103.11, 117.28, 229/117.35; 220/495.05
See application file for complete search history.

(56) References Cited

U.S. PATENT DOCUMENTS

| | | | | |
|---|---|---|---|---|
| 2,986,321 | A * | 5/1961 | Schaich | 229/101.2 |
| 3,087,655 | A * | 4/1963 | Scholle | 222/183 |
| 3,090,526 | A * | 5/1963 | Hamilton et al. | 222/105 |
| RE32,956 | E * | 6/1989 | Schuster | 206/428 |

(Continued)

FOREIGN PATENT DOCUMENTS

| | | |
|---|---|---|
| DE | 1120355 | 12/1961 |

(Continued)

*Primary Examiner* — Nathan J Newhouse
*Assistant Examiner* — Christopher Demeree
(74) *Attorney, Agent, or Firm* — Millen, White, Zelano & Branigan, P.C.

(57) ABSTRACT

In carton packaging having an outer folding carton and an inner folding carton which surrounds a film internal container, the inner folding carton is adhesively bonded by means of one of its carton body walls (14) to an adjacent carton body wall (6) of the outer folding carton. The outer folding carton and the inner folding carton surround the film internal container essentially completely. The film internal container consists of a flexible film internal bag provided with a withdrawal closure. The carton body walls (13, 14, 15, 16) of the inner folding carton are connected to one another in a foldable manner at the body edges (17, 18, 19, 20) via carton bridges, each bridging an edge slot. The lid flaps of the inner folding carton are angled in the finished carton packaging. The inner folding carton and the outer folding carton consist of a joint carton blank or each consist of a separate carton blank or each consist of a plurality of carton blanks.

10 Claims, 7 Drawing Sheets

U.S. PATENT DOCUMENTS

| | | | |
|---|---|---|---|
| 5,988,491 | A | 11/1999 | Morrison |
| 2006/0243783 | A1 | 11/2006 | Spivey, Sr. |

FOREIGN PATENT DOCUMENTS

| | | | |
|---|---|---|---|
| DE | 3016466 | A1 | 11/1980 |
| DE | 3629260 | A1 | 3/1988 |
| DE | 3629260 | W | 3/1988 |
| WO | 02083510 | A1 | 10/2002 |
| WO | PCTEP0804877 | R | 10/2008 |

* cited by examiner

CARTON PACKAGING WITH FILM INTERNAL CONTAINER, PREFABRICATED CARTON UNIT FOR THE PRODUCTION THEREOF, AND PROCESS FOR THE PRODUCTION OF CARTON PACKAGING OF THIS TYPE

The invention relates to carton packaging having an outer folding carton and an inner folding carton which surrounds a film internal container. The outer and inner folding cartons preferably surround the film internal container essentially completely. The film internal container usually consists of a flexible film internal bag provided with a withdrawal closure.

Liquid packaging of this type, which serves for the storage, transport and withdrawal of liquids, is known in various embodiments. The flexible film internal bags accommodated in a folding carton have the advantage over rigid liquid packaging that the liquid accommodated does not come into contact with atmospheric oxygen due to the film internal bag, which collapses on withdrawal, and therefore has a longer shelf life.

DE 11 20 355 describes a folding box with a plastic bag arranged therein. In order to be able to fix a withdrawal closure at a pre-specified position within the folding box, a holder which has a plate with an aperture for the accommodation of the withdrawal closure arranged below the lid of the folding box is located within the folding box. The holder can be connected to the folding box by means of attachment means in order to prevent sliding of the holder with the withdrawal closure fixed thereto. The holder arranged in the interior of the folding box increases the stability of the folding box only insignificantly.

DE 30 16 466 A1 describes a similar folding box which likewise has a plate for the accommodation of the withdrawal closure arranged below the lid of the folding box. However, this plate is angled in order to avoid undesired air inclusions in the hose during filling of the hose arranged in the folding box through the withdrawal closure. The withdrawal closure is therefore fixed at the highest point of the angled plate. The plate is supported on the base of the folding box and attached at the side to a body wall of the folding box. Here too, the stability of the folding box is only improved insignificantly by the plate arranged and supported in the interior.

The mechanical strength of packaging, which is particularly important for transport, is exclusively achieved in such carton packaging by the folding carton which accommodates the film internal bag. In most cases, the carton must be very stable in order to meet the requirements of hazardous goods regulations both during use and also during transport. In many cases, the requirements of hazardous goods regulations for the accommodation and transport of hazardous liquids can only be met by using an additional outer folding carton in addition to the inner folding carton containing the film internal bag.

The carton packagings mentioned at the outset having an outer folding carton and an inner folding carton which contains the flexible film internal bag are known from practice. However, carton packagings of this type for liquids of the "carton-in-carton" design can only be processed inconveniently in production. In particular, they cannot be processed on a fully automatic machine. Although the inner folding carton accommodating the film internal bag can be prepared and assembled on a fully automatic machine, it must, however, be inserted into the outer folding carton by hand.

The object of the invention is therefore to create carton packaging of the generic type mentioned at the outset which is simple to process and fill and can also be filled on a fully automatic machine. At the same time, the hazardous goods conditions intended for chemicals should be met. The packaging should meet high safety requirements during transport and use.

This object is achieved in that the inner folding carton is adhesively bonded by means of one of its carton body walls to an adjacent carton body wall of the outer folding carton.

The stable connection of the inner folding carton to the outer folding carton results in significantly increased overall strength of the carton packaging. Handling of the carton packaging is significantly simplified since the inner folding carton is connected reliably and in a positionally accurate manner to the outer folding carton by the adhesive bond. In particular, the position of the inner folding carton in the outer folding carton is fixed in such a way that externally acting impacts or similar loads are kept away from the inner folding carton and in particular from the film internal bag in an optimum manner.

The outer and inner folding cartons preferably consist of corrugated cardboard. However, it is also conceivable and advantageous for some applications for the outer and/or inner folding carton partially or fully to consist of a plastic material or of a composite material.

The filling operation is also simplified and facilitated since the carton structure accommodating the film internal container can be handled like a uniform folding carton owing to the adhesive bond between the inner folding carton and the outer folding carton. Processing on a fully automatic machine during assembly, filling and sealing of the liquid packaging is thereby also facilitated and simplified. The film internal container is preferably a flexible film internal bag with a withdrawal closure. However, it is also conceivable for the film internal container to be formed by an essentially dimensionally stable film bubble or by a film coating of the inner folding carton.

The sub-claims relate to carton packaging embodiments according to the invention.

The invention also relates to a prefabricated carton unit for the production of carton packaging described above and to a process for the production of carton packaging of this type.

The invention is explained in greater detail with reference to the illustrative embodiment described below and depicted in the drawing, in which.

Figure 7:
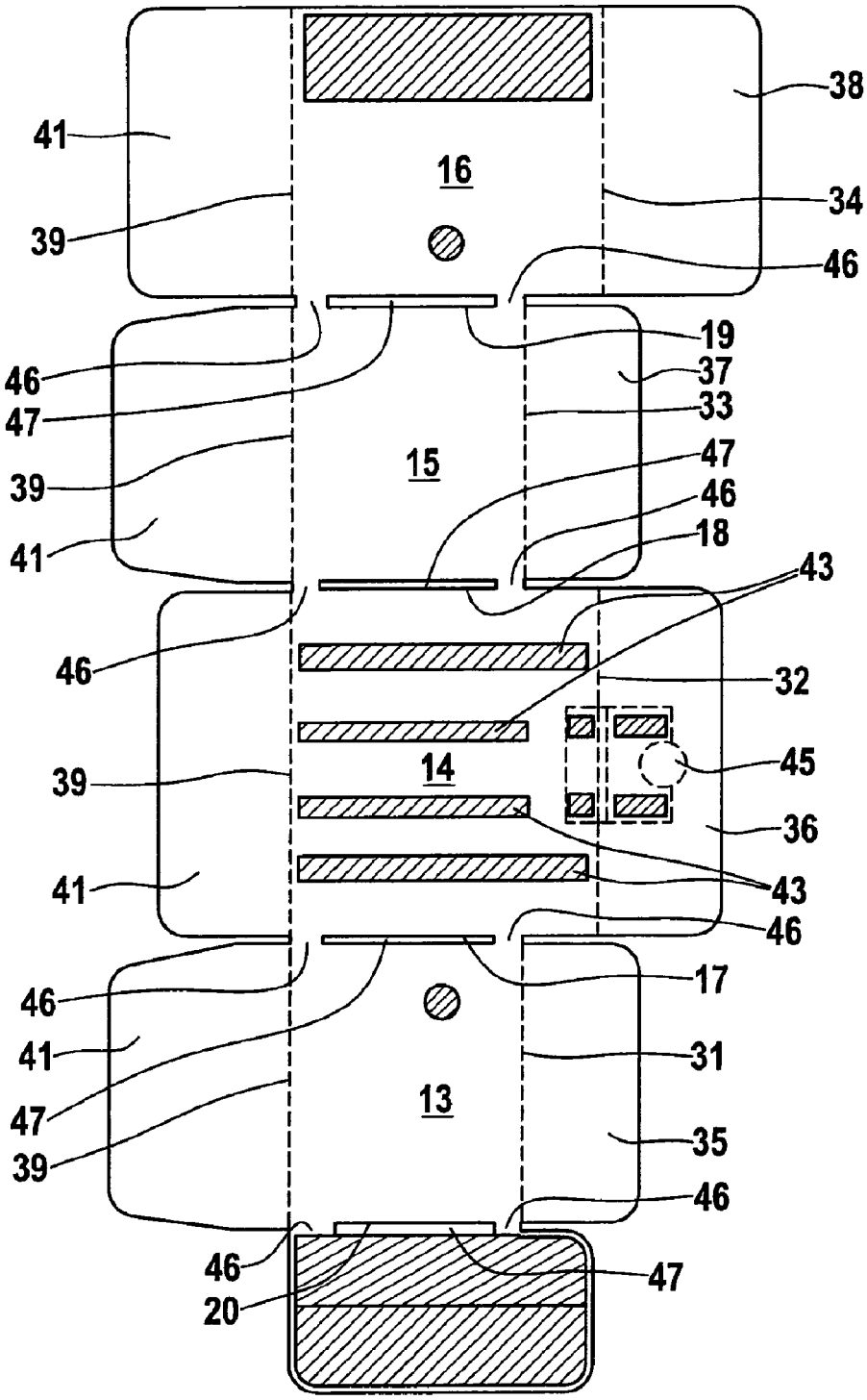
Figure 8:
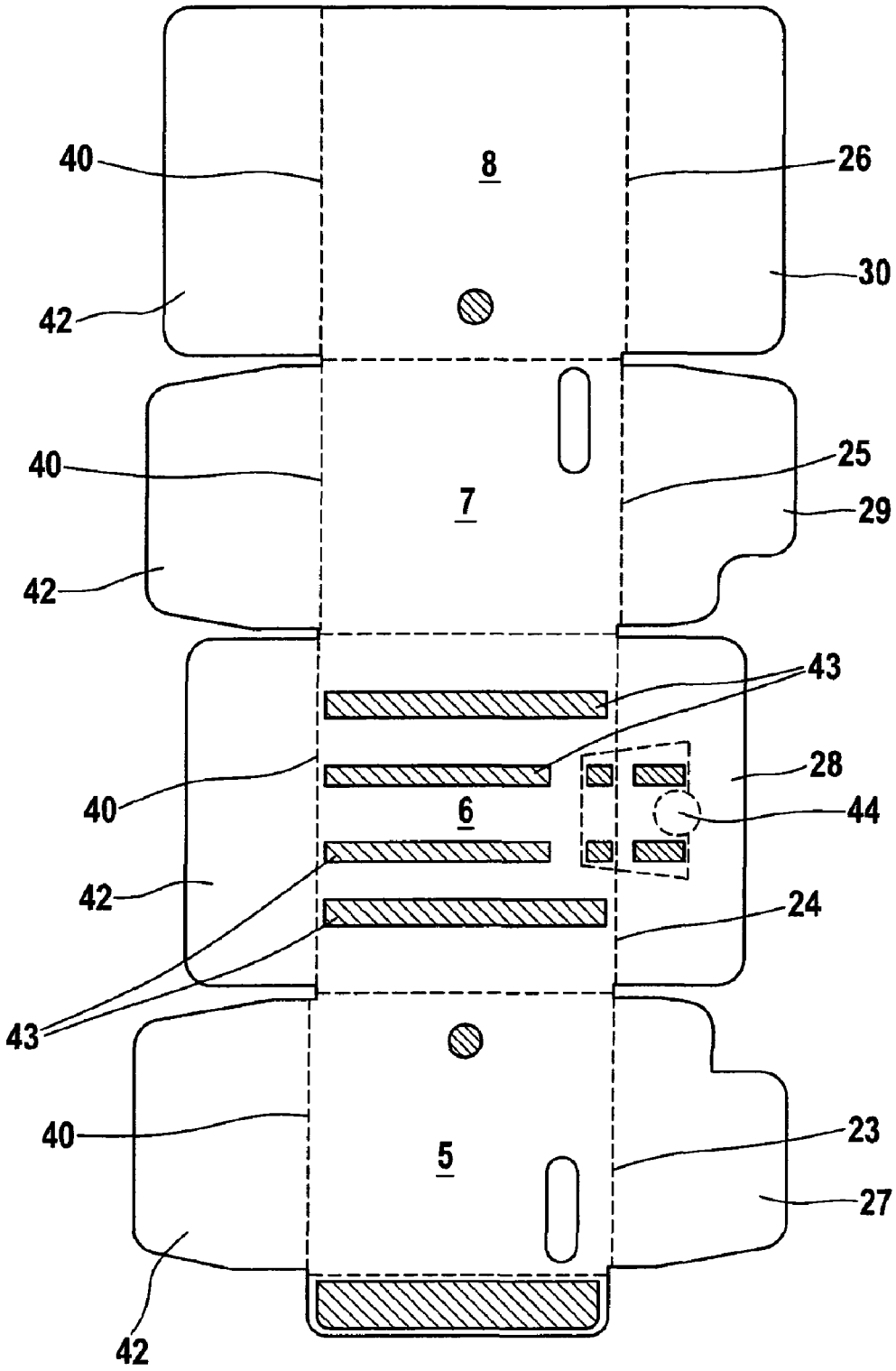
Figure 9:
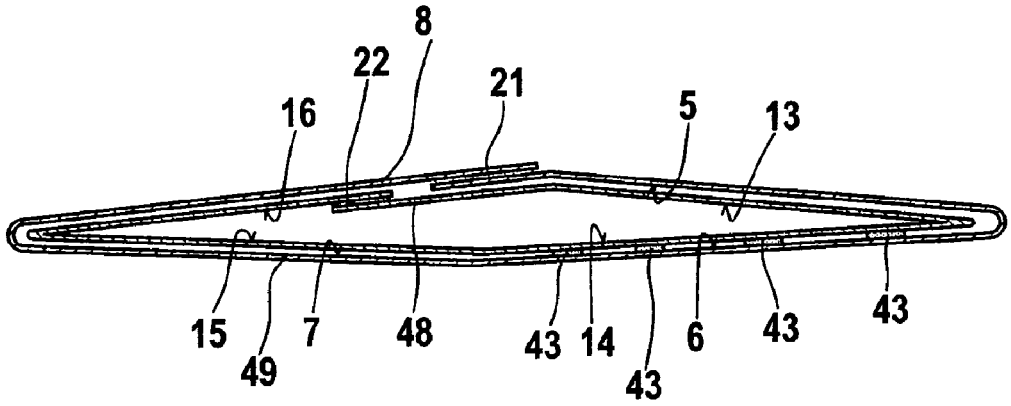
Figure 10:
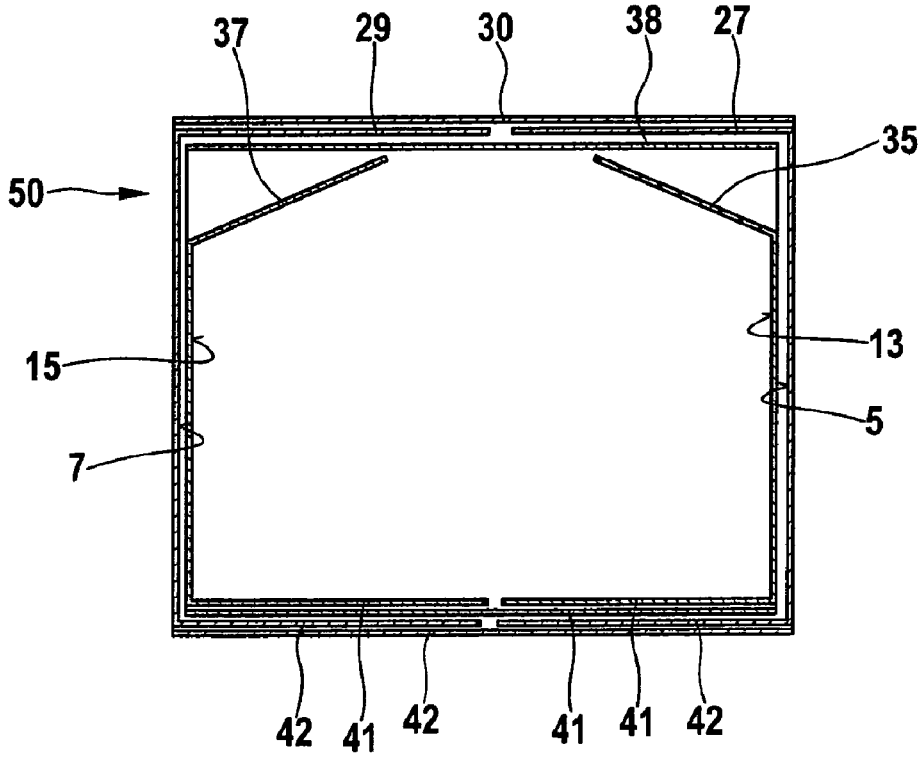

FIGS. 3-6 each show a top view of the carton packaging in successive steps during the sealing of the packaging, where a film internal container is not depicted in FIGS. 4-6, FIG. 7 shows a flat blank for the production of the inner folding carton, FIG. 8 shows a flat blank for the production of the outer folding carton, FIG. 9 shows a diagrammatic representation of a prefabricated carton unit for the production of carton packaging, and FIG. 10 shows a sectional view of the carton packaging with angled lid flaps of an inner folding carton.

The carton packaging depicted in FIGS. 1-6 has an outer folding carton 1 and an inner folding carton 2, which contains a flexible film internal bag 4 provided with a withdrawal closure 3 which is intended for the accommodation of the liquid to be packaged.

The withdrawal closure 3, which is not depicted in greater detail here, may be a tap. If the carton packaging serves for the accommodation of, for example, titration liquid, the tap integrated into the withdrawal closure can be connected in a simple manner to a titrator via an adapter (not shown). Since the film internal bag 4 collapses during the withdrawal of the liquid, there is no risk of the liquid being contaminated. Air bubbles do not enter the film internal bag 4.

The outer folding carton 1 has four carton body walls 5, 6, 7 and 8, which are connected to one another in a foldable manner at the body edges 9, 10, 11 and 12 for the formation of a carton body.

In a corresponding manner, the inner folding carton 2 has carton body walls 13, 14, 15 and 16, which are connected at the body edges 17, 18, 19 and 20 to form a carton body.

Figure 2:
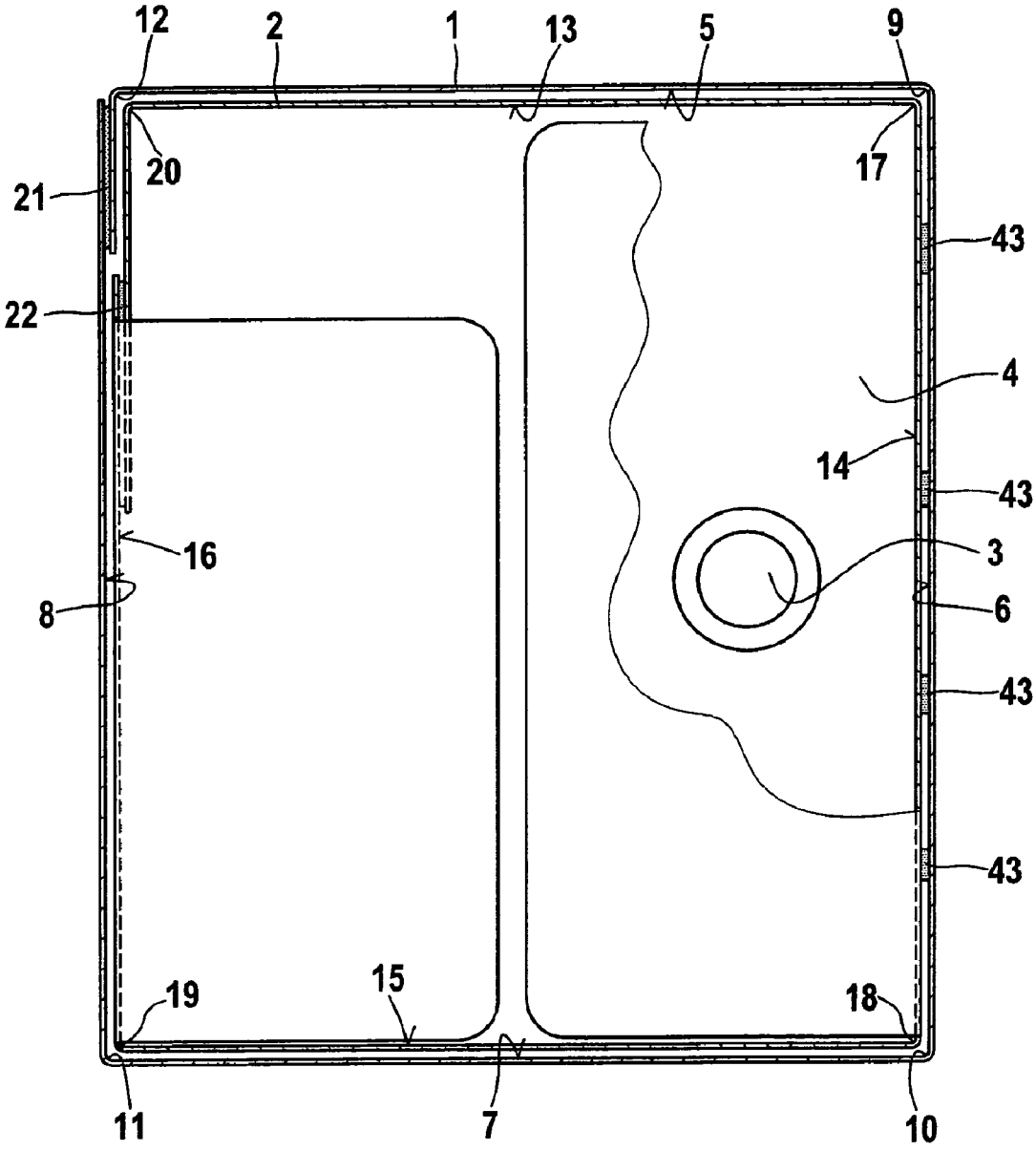
FIG. 2 shows a section along line II-II in FIG. 1.

The outer folding carton 1 and the inner folding carton 2 are each formed from a carton folding sleeve, which in each case has an adhesive bond 21 and 22 in a carton body wall 8 and 16 respectively (FIG. 2).

The outer folding carton 1 has lid flaps 27, 28, 29 and 30 attached in a foldable manner to each of the upper edges 23, 24, 25 and 26 of its carton body walls 5, 6, 7 and 8.

In a corresponding manner, lid flaps 35, 36, 37, 38 are attached in a foldable manner to the upper edges 31, 32, 33 and 34 of the carton body walls 13, 14, 15 and 16 in the inner folding carton 2.

The inner folding carton 1 and the outer folding carton 2 each have base flaps 41 and 42 attached in a foldable manner to the lower edges 39 and 40 respectively of their carton body walls 13, 14, 15, 16 and 5, 6, 7, 8 respectively.

The inner folding carton 2 is adhesively bonded by means of its first carton body wall 14 to the adjacent carton body wall 6 of the outer folding carton 1 by means of adhesive 43 applied in a strip-like manner. In addition, an adhesive bond (not shown here) may also be provided between the respectively adjacent carton body walls 5 and 13 or 7 and 15.

The lid flap 28, which is attached in a foldable manner to the carton body wall 6, adhesively bonded to the inner folding carton 2, of the outer folding carton 1, has an openable access aperture 44. A corresponding openable access aperture 45 is also provided in the lid flap 36, arranged below this, of the inner folding carton 2. After opening of the access apertures 44 and 45, access to the withdrawal closure 3, arranged below this, of the film internal bag 4 is possible.

As can be seen from the depiction of the blank in FIG. 7, the carton body walls 13, 14, 15 and 16 of the inner folding carton 2 are connected to one another in a foldable manner at the body edges 17, 18, 19 and 20 via carton bridges 46, each bridging an edge slot 47. A particularly flexible design of the inner folding carton 2 is thus achieved, so that it fits the outer folding carton 1 well not only in the erected state (FIGS. 1-6), but also in the folded-flat state (FIG. 9).

The upper edges 31 and 33 of the two carton body walls 13 and 15 of the inner folding carton 2, which lie opposite one another and are each provided with a lid flap 35, 37, which is attached in a foldable manner, lie, in the finished state, lower than the upper edges 23, 24, 25 and 26 of the carton body walls 5, 6, 7 and 8 of the outer folding carton 1. It is thus achieved that the lid flaps 35 and 37 rest on the filled film internal container 4 in a roof-shaped manner.

The inclined position of the lid flaps 35 and 37 significantly increases the stability of the finished carton packaging. In addition, the inclined lid flaps 35 and 37 form a funnel-shaped end piece, which guides the liquid in the direction of the withdrawal closure. In addition, the inclined position of the lid flaps 35 and 37 prevents right-angled corners of the carton packaging.

Figure 1:
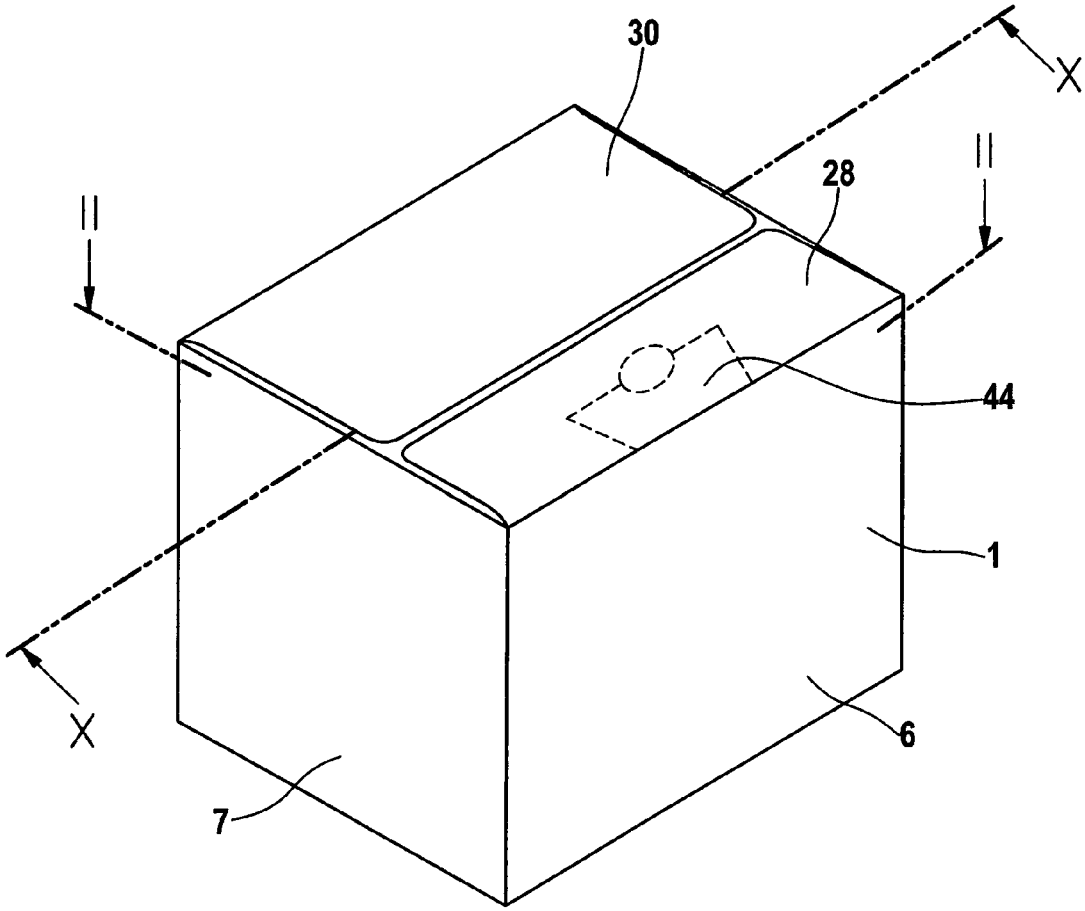
FIG. 1 shows a perspective view of carton packaging.

FIG. 10 shows, for illustration, a sectional view of the carton packaging depicted in FIG. 1 along the plane X-X. Perforated grip holes may be provided in the upper regions 50 in the outer folding carton 1. Handling of the carton packaging is then significantly simplified since neither an inner folding carton 2 nor a film internal bag 4 is arranged close to the region of the grip holes in the interior and there is sufficient space for gripping.

In the illustrative embodiment depicted, the outer folding carton 1 and the inner folding carton 2 each consist of a separate carton blank, which are depicted in FIGS. 8 and 7 respectively. Instead, it may also be provided that the outer folding carton 1 and the inner folding carton 2 consist of a joint carton blank. It is likewise conceivable for the outer folding carton 1 and/or the inner folding carton 2 to consist of two or more carton blanks.

FIG. 9 shows a front view of a prefabricated carton unit, as provided for the production of carton liquid packaging of the type described and supplied to the user. A folded-flat carton folding sleeve 48, which later forms the inner folding carton 2, is arranged in a folded-flat outer carton folding sleeve 49, which later forms the outer folding carton 1. The first carton body wall 14 of the inner carton folding sleeve 48 is adhesively bonded to the adjacent carton body wall 6 of the outer carton folding sleeve 49.

Figure 3:
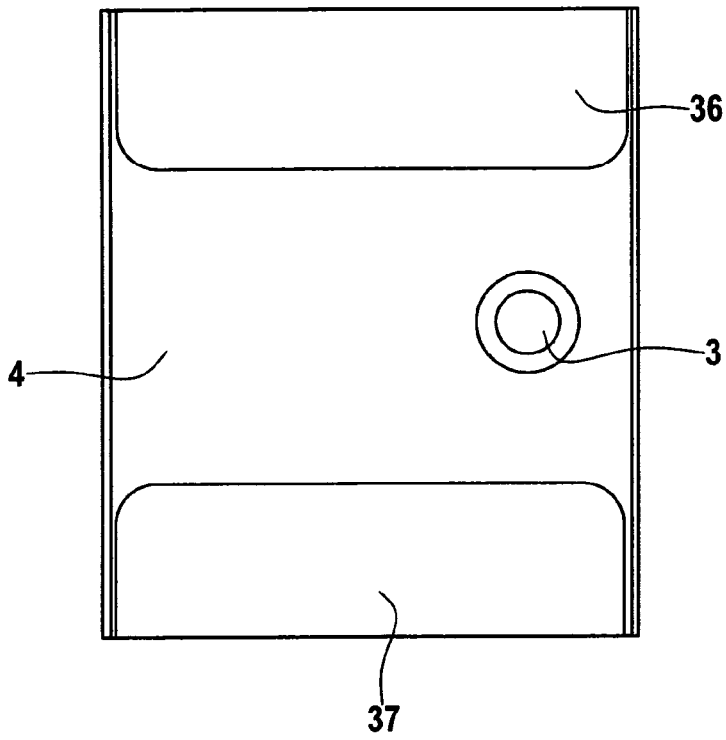
Figure 4:
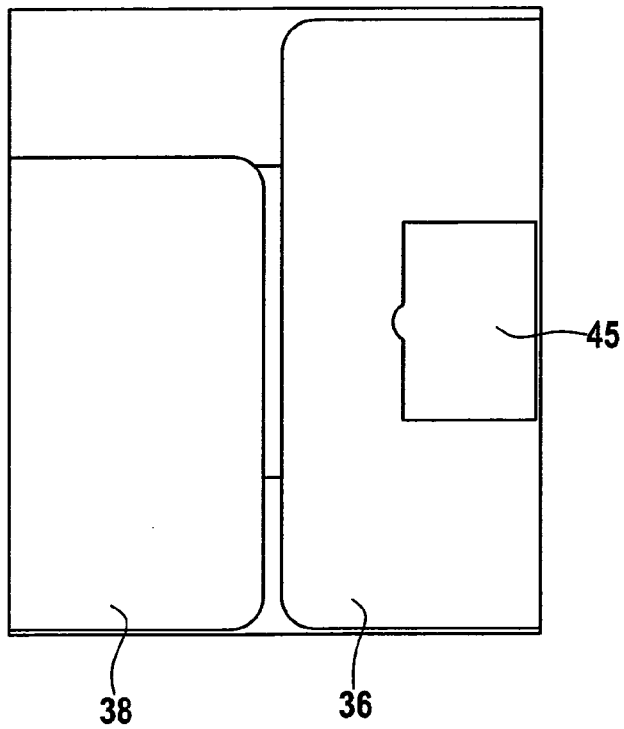
Figure 5:
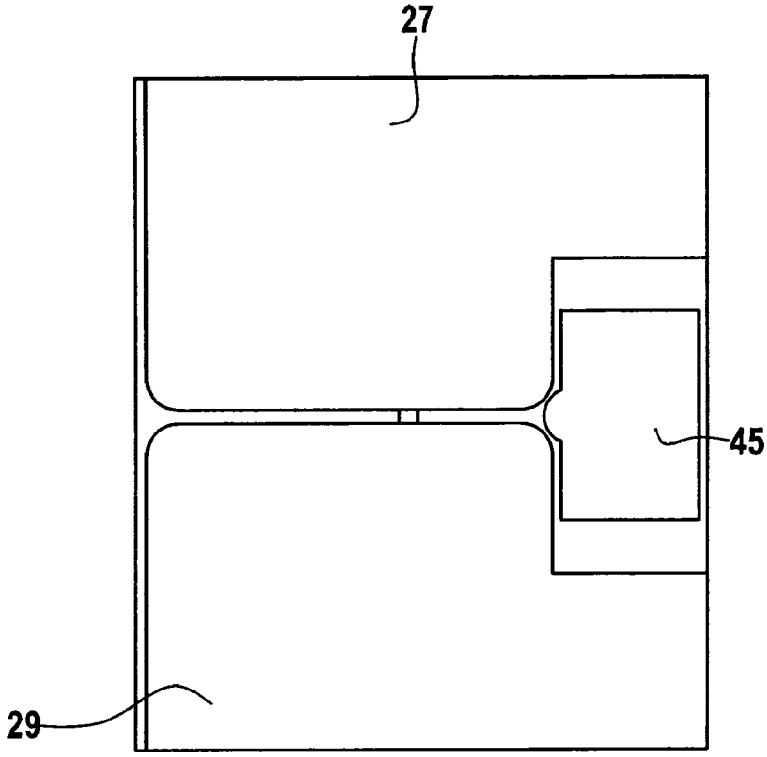
Figure 6:
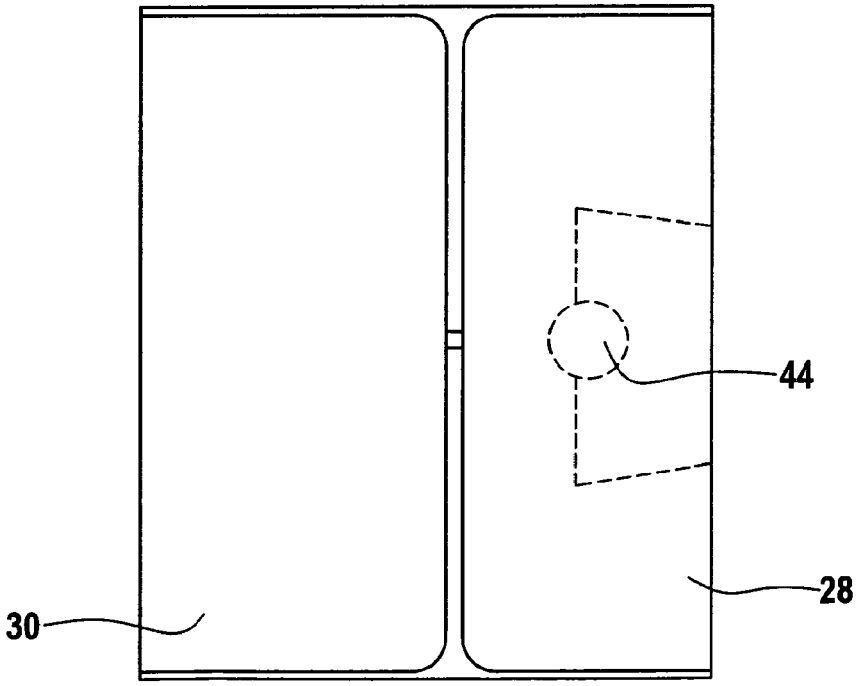

The prefabricated carton unit can be erected in a simple manner from the folded-flat state depicted diagrammatically in FIG. 9. After insertion and filling of the film internal bag 4, the liquid packaging is sealed in the manner as depicted in FIGS. 3-6. Firstly, the two lid flaps 35 and 37 are folded onto the film internal bag 4 at an angle (FIG. 3). The two other lid flaps 36 and 38 of the inner folding carton 2 are then folded inwards (FIG. 4). The lid flaps 27 and 29 of the outer folding carton 1 are placed thereon (FIG. 5). Finally, the liquid packaging is sealed by means of the lid flaps 28 and 30.

The process for the production of carton packaging of the type described is preferably characterised by the following process steps:

a) cutting-out of an inner carton blank (FIG. 7) for the inner folding carton 2;
b) cutting-out of an outer carton blank (FIG. 8) for the outer folding carton 1;
c) adhesive bonding of a carton body wall 14 of the inner carton blank to a carton body wall 6 of the outer carton blank;
d) folding up and adhesive bonding of the inner carton blank to a flat inner carton folding sleeve 48;
e) folding up and adhesive bonding of the inner carton blank to an outer carton folding sleeve 49 surrounding the inner carton folding sleeve 48;
f) assembly and sealing of the base side of the carton folding sleeves 48, 49, which are adhesively bonded to one another;
g) if desired, introduction of the flexible film internal bag 4 into the inner folding carton 2;
h) sealing of the lid side of the inner folding carton 2 and the outer folding carton 1.

Instead of a liquid, any other flowable or viscose material can also be introduced into the film internal container, or the film internal bag 4, transported and stored and withdrawn again. The film internal container may then also be designed as a coating of the inner folding carton 2, depending on the material to be accommodated.

The inner folding carton 2 and the outer folding carton 1 are preferably made of corrugated cardboard. However, it is also conceivable for the inner and/or outer folding cartons 2, 1 to be made of plastic or a suitable composite material. Depending on the material used for the inner and outer folding cartons 2, 1, they may be attached to one another by means of suitable attachment means or attachment methods, so that an adhesive does not necessarily have to be used.

In most of the illustrative embodiments described above, a suitable design of the dimensions in combination with the materials used allows the production of carton packaging which meets the common safety requirements for transport and storage of hazardous materials and is nevertheless suitable for use in machines, i.e. can be used on an automatic filling machine.

The invention claimed is:

1. Carton packaging having an outer folding carton (1) and an inner folding carton (2) which surrounds a film internal container, where the inner folding carton (2) is adhesively bonded by means of one of its carton body walls (14) to an adjacent carton body wall (6) of the outer folding carton (1), characterised in that the outer folding carton (1) and the inner folding carton (2) surround the film internal container essentially completely, in that the inner folding carton (2) and the outer folding carton (1) each have lid flaps (35, 36, 37, 38 and 27, 28, 29, 30 respectively), which are attached in a foldable manner to the upper edges (31, 32, 33, 34 and 23, 24, 25, 26 respectively) of their carton body walls (13, 14, 15, 16 and 5, 6, 7, 8 respectively) and in that the upper edges (31, 33) of the two carton body walls (13, 15) of the inner folding carton (2), which lie opposite one another and are each provided with a lid flap (35, 37), which is attached in a foldable manner, are arranged lower than the upper edges (23, 24, 25, 26) of the carton body walls (5, 6, 7, 8) of the outer folding carton (1) and wherein lid flaps (35, 37) of the inner folding carton (2) are angled at an incline that prevents right angled corners in the finished carton packaging.

2. Carton packaging according to claim 1, characterised in that the carton body walls (13, 14, 15, 16) of the inner folding carton (2) are connected to one another in a foldable manner at the body edges (17, 18, 19, 20) via carton bridges (46), each bridging an edge slot (47).

3. Carton packaging according to claim 1, characterised in that the inner folding carton (2) is adhesively bonded by means of a further carton body wall to an adjacent carton body wall of the outer folding carton (1).

4. Carton packaging according to claim 3, characterised in that a lid flap (28), which has an openable access aperture (44) to the withdrawal closure (3), arranged below this, of the film internal container, is attached in a foldable manner to the carton body wall (6), which is adhesively bonded to the inner folding carton (2), of the outer folding carton (1).

5. Carton packaging according to claim 1, characterised in that the film internal container consists of a flexible film internal bag (4) provided with a withdrawal closure.

6. Carton packaging according to claim 1, characterised in that the inner folding carton (2) and the outer folding carton (1) are each formed from a carton folding sleeve (48 and 49 respectively), each of which has an adhesive bond (22 and 21 respectively) in a carton body wall (16 and 8 respectively).

7. Carton packaging according to claim 1, characterised in that the inner folding carton (2) and the outer folding carton (1) each have base flaps (41 and 42 respectively) attached in a foldable manner to the lower edges (39, 40) of their carton body walls (13, 14, 15, 16 and 5, 6, 7, 8 respectively).

8. Carton packaging according to claim 1, characterised in that the inner folding carton (2) and the outer folding carton (1) each consist of a separate carton blank.

9. Carton packaging according to claim 1, characterised in that the inner folding carton (2) and the outer folding carton (1) consist of a joint carton blank.

10. Prefabricated carton unit for the production of carton packaging according to claim 1, characterised in that a folded-flat inner carton folding sleeve (48) is arranged in a folded-flat outer carton folding sleeve (49), where at least one carton body wall (14) of the inner carton folding sleeve (48) is adhesively bonded to an adjacent carton body wall (6) of the outer carton folding sleeve (49).

* * * * *